US006004026A

United States Patent [19]

Slowinski

[11] Patent Number: 6,004,026

[45] Date of Patent: Dec. 21, 1999

[54] DIAMOND BRACELET WATCH

[75] Inventor: Christopher Slowinski, New York, N.Y.

[73] Assignee: Christopher Designs, Inc., New York, N.Y.

[21] Appl. No.: 09/024,245

[22] Filed: Feb. 17, 1998

[51] Int. Cl.[6] ..... G04B 37/00

[52] U.S. Cl. ..... 368/282; 63/5 A

[58] Field of Search ..... 368/281–289, 368/223–239; 63/5 A

[56] References Cited

U.S. PATENT DOCUMENTS

| | | | |
|---|---|---|---|
| 2,179,294 | 11/1939 | Heit | 368/285 |
| 4,627,739 | 12/1986 | Shingo et al. | 368/282 |
| 4,855,972 | 8/1989 | Eiss | 368/282 |
| 5,400,304 | 3/1995 | Offenstein | 368/285 |
| 5,479,381 | 12/1995 | Goldenberg | 368/282 |

FOREIGN PATENT DOCUMENTS

| | | | |
|---|---|---|---|
| 680893 | 12/1992 | Switzerland | 368/285 |
| 2243003 | 10/1991 | United Kingdom | 368/285 |

*Primary Examiner*—Bernard Roskoski
*Attorney, Agent, or Firm*—Ostrolenk, Faber, Gerb & Soffen, LLP

[57] ABSTRACT

A watch constructed from a plurality of link members. Each link member including a plurality of holes in one side and a plurality of corresponding pins in the other side. The link members are fastened together by insertion of the pin members from one link into the hole of the corresponding adjacent link after which the pin members are crimped backwards over the adjacent member thereby fastening the two links together. The top surface of each link member has a radius of curvature whereby gems, invisibly mounted in the link member, will exhibit increased sparkle. When fully assembled, the gems mounted in the link members will be aligned in a linear fashion. These linear rows of gems are continued across the face of the watch thereby presenting a coherent and aesthetically pleasing watch. To the bottom of each link member is fastened a bottom plate. When fully assembled and worn by a user, the bottom plates of each of the link members provide a continuous and smooth surface against the wrist of the user.

11 Claims, 4 Drawing Sheets

FIG. 4
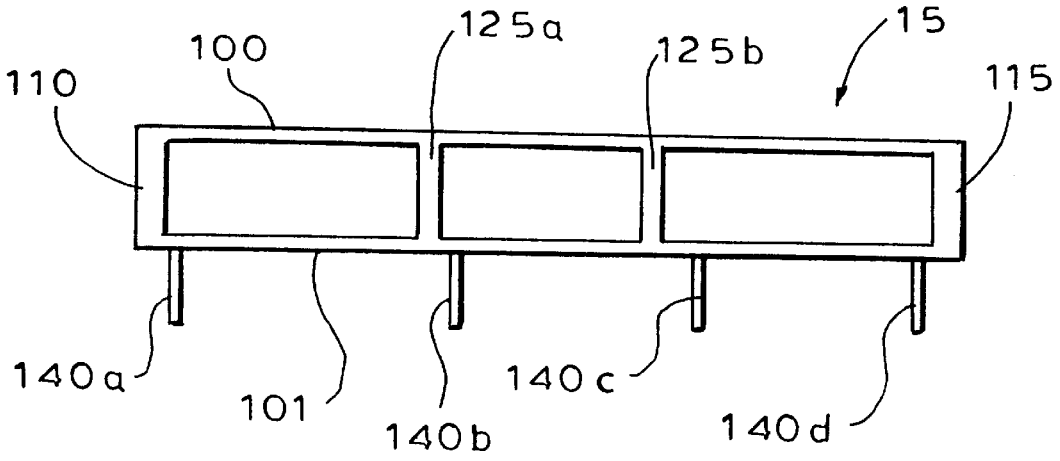
FIG. 5
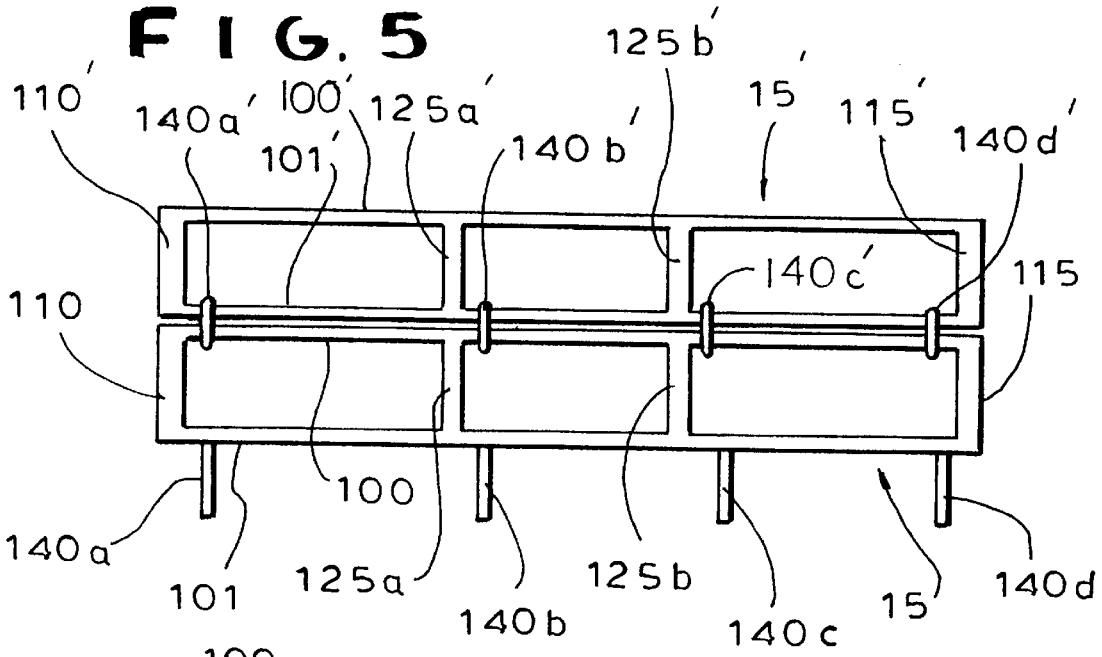
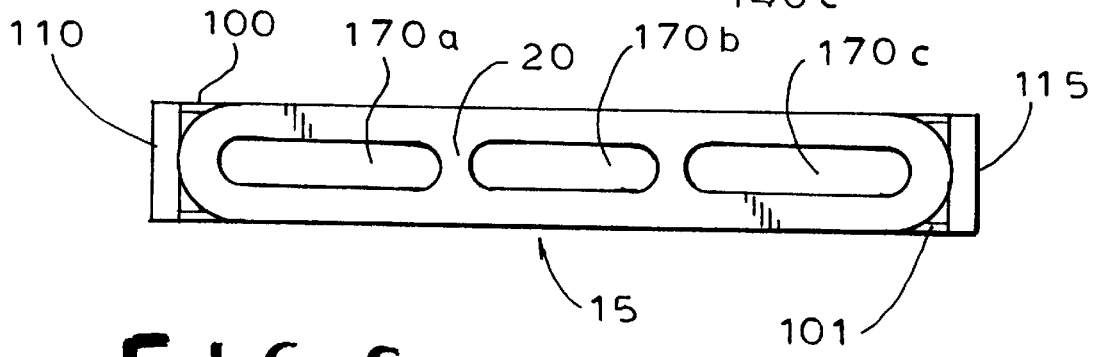
FIG. 6

DIAMOND BRACELET WATCH

FIELD OF THE INVENTION

The present invention relates generally to watches and more specifically to a watch having a continuous band with gems mounted linearly thereon.

SUMMARY OF THE INVENTION

The watch of the present invention is constructed from a plurality of link members. Each of the link members include a plurality of holes in one side and a plurality of corresponding pins in the other side. The link members are fastened together by insertion of the pin members from one link into the hole of the corresponding adjacent link after which the pin members are crimped backwards over the adjacent member thereby fastening the two links together. The top surface of each link member has a radius of curvature whereby gems, invisibly mounted in the link member, will exhibit increased sparkle. When fully assembled, the gems mounted in the link members will be aligned in a linear fashion. These linear rows of gems are continued across the face of the watch thereby presenting a coherent and aesthetically pleasing watch. To the bottom of each link member is fastened a bottom plate. When fully assembled and worn by a user, the bottom plates of each of the link members provide a continuous and smooth surface against the wrist of the user.

One of the key distinguishing features of the invention is that the width of the band or bracelet perfectly matches the width of the watch which creates the appearance of a continuous bracelet that extends through and includes the watch itself. It is as though the watch movement is embedded in the bracelet.

Other features and advantages of the present invention will become apparent from the following description of the invention which refers to the accompanying drawings.

BRIEF DESCRIPTION OF THE DRAWINGS

FIG. 4 depicts a bottom view of a link member.

FIG. 5 depicts the manner in which two adjacent link members are attached.

FIG. 6 depicts a bottom view of a link member including the bottom plate.

DETAILED DESCRIPTION OF THE INVENTION

Figure 1:
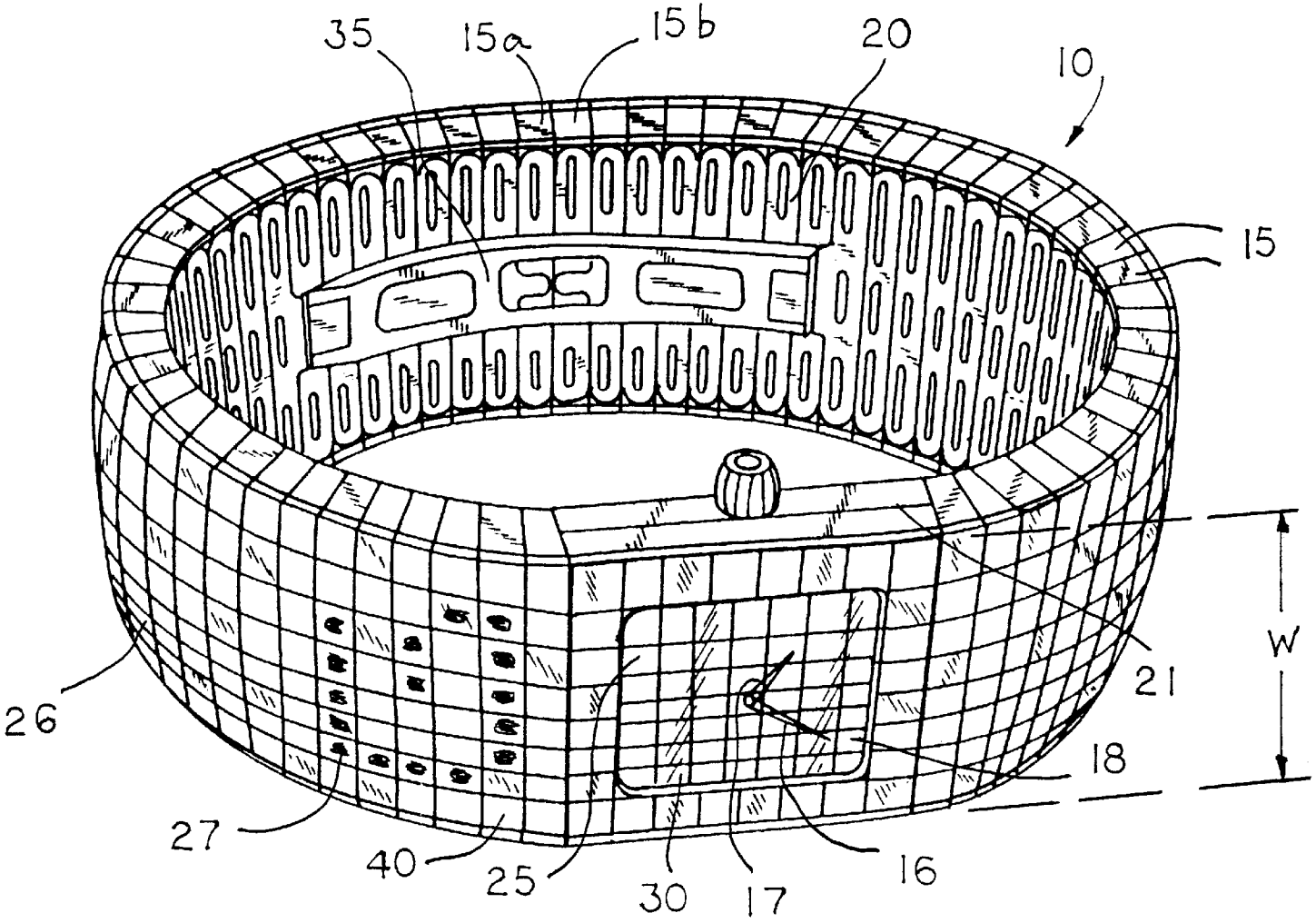
FIG. 1 is a perspective view of a watch according to the present invention.

A watch constructed according to the present invention is depicted in FIG. 1. As shown in this Figure, the diamond bracelet watch 10 consists of the watch component 25 including a transparent watch crystal 30. The band of watch 10 is constructed from a plurality of links 15 to which bottom plates 20 are attached. The watch is closed by latch 35. Although not depicted in FIG. 1, when latch 35 is opened, there will be a gap between two link members 15*a* and 15*b* which will allow a user to put the watch on.

As can be seen from FIG. 1, the band 26 is studded with a plurality of gems 40. The gems 40 are aligned in a continuous linear fashion around the entire band of the watch, including the recessed face of the watch below the crystal 30. In a preferred embodiment the gems are mounted using an invisible mounting technique, such as described in the present inventor's U.S. Pat. Nos. 5,072,601 and 5,548,976, the contents of which are incorporated by reference herein. The watch handles 16 and 17 are disposed above the bed of gems 18 which defines the bottom of the watch below the watch crystal 30.

As described above, the watch 10 of the present invention is characterized in that both the band and the watch movement itself are fully lined and covered by gems, preferably square or rectangularly shaped diamonds. Each line of diamonds comprises invisibly mounted diamonds which follow one another on a straight line circumferentially around the band of the watch with the line of diamonds continuing straight through the watch casing 21. The circumferential lines of diamonds lie tightly adjacent one another across the width of the band and the watch. Preferably, the diamonds in each of the circumferential lines align with one another producing lines of diamonds which extend across the width of the watch band and the watch itself. The width "W" is of the same dimension at both the watch 25 and the band 26. Note that the diamonds which are located below the watch crystal 30 are similarly aligned with the diamonds that are located on the band. Since the diamonds are invisibly mounted, they abut one another without showing any of the mounting hardware which lies below the diamonds. Further, since the facing surface of each link is arcuate as shown in FIG. 2, the diamonds sparkle and reflect light in different directions producing a brilliantly sparkling band.

Figure 2:
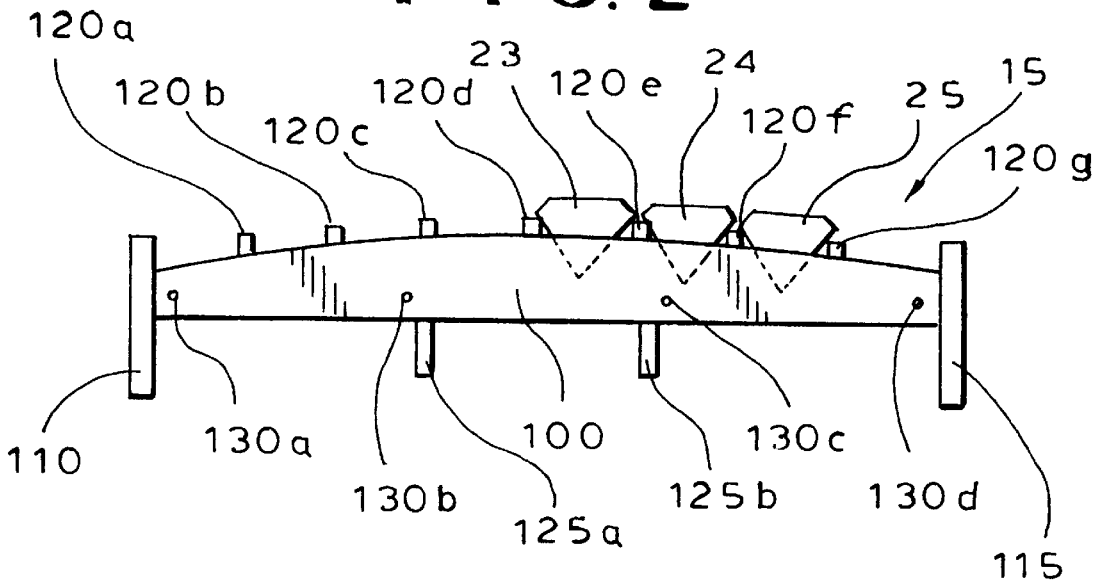
FIG. 2 illustrates a side view of a link member.

FIG. 2 depicts a side view of a single link member 15, from which the band of watch 10 is constructed. Each link 15 includes two end supports 110 and 115. Spanning between the two end supports 110 and 115 are side walls 100 and 101 (see FIG. 3). A feature of each of the side walls 100 and 101 is the curvature provided in the top edges thereof. This curvature is significant in that as the gems are mounted in a link 15, the curvature causes each gem to point at a slightly different direction causing light to reflect in slightly different direction relative to each other (as opposed to planar mounted gems), thereby imparting additional sparkle to the band.

Spanning between side walls 100 and 101 are mounting support members 120*a*–120*g*. These support members 120*a*–120*g* allow the invisible mounting of the gems in each link 15. FIG. 2 shows several diamonds 23, 24, 25 mounted in the link 15. Note that the girdles of the diamonds abut one another so that in FIG. 1 one sees literally wall-to-wall diamonds, totally obscuring the underlying support structure.

There are several apertures 130*a*–130*d* formed in side wall 100. The function of these apertures shall be discussed in connection with later Figures.

Figure 3:
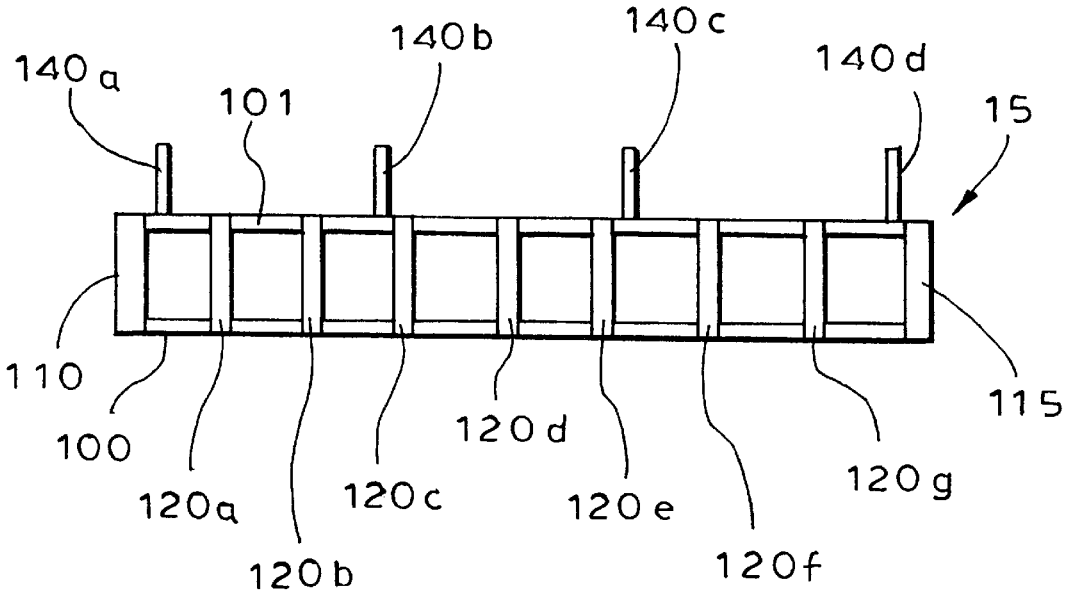
FIG. 3 depicts a top view of a link member.
Figure 7:
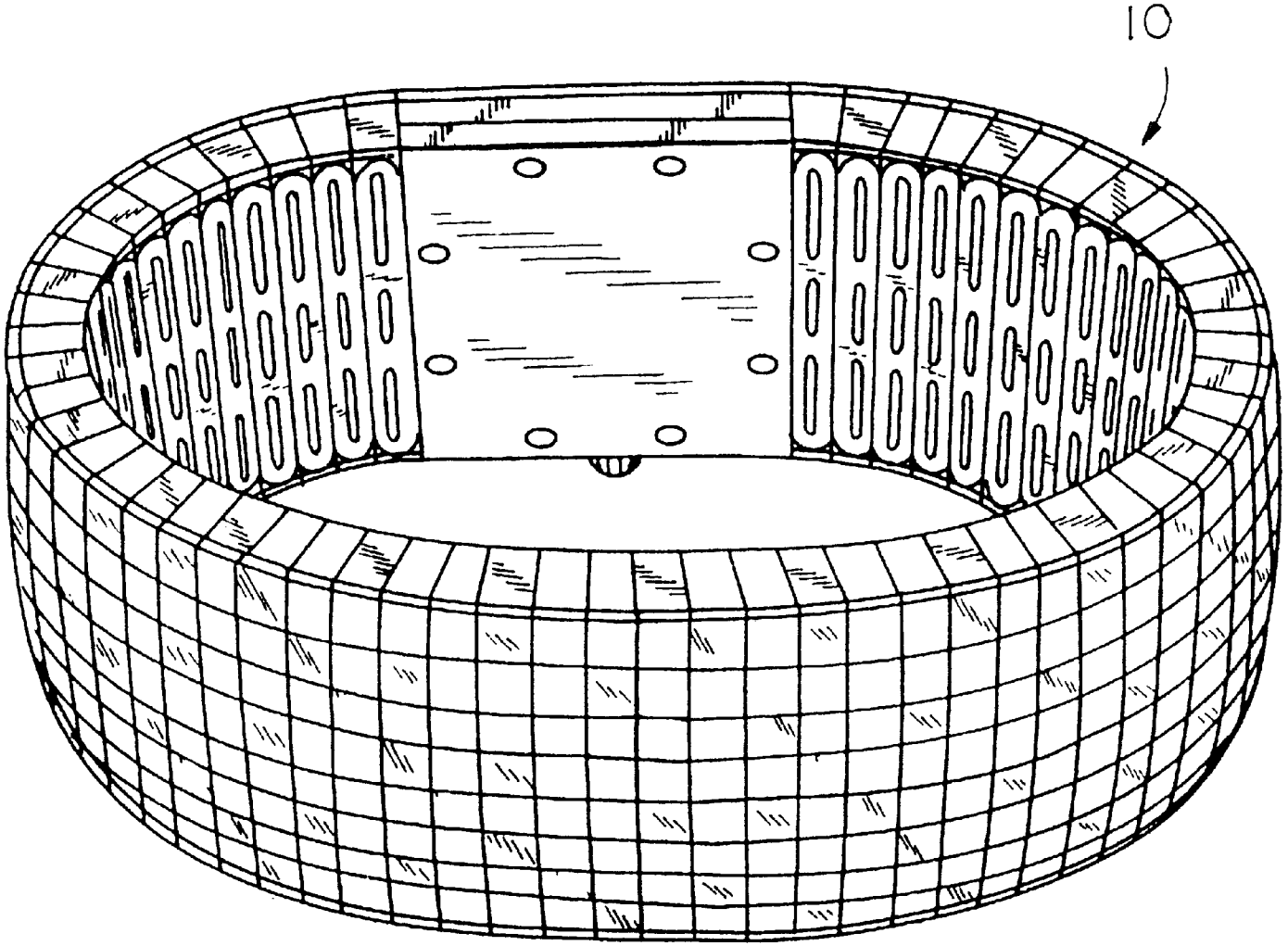
FIG. 7 is a perspective view of the watch of the present invention showing the bottom surface of the watch.

FIG. 3 depicts a top view of link 15. As seen in this Figure, side wall 101 (which is parallel to side wall 100) includes several pins 140*a*–140*d*. The pins 140*a*–140*d* are manufactured from a flexible wire, preferably gold, capable of deformation and their function will be explained below in detail.

FIG. 4 depicts a bottom view of link 15. This view of link 15 depicts plate supports members 125*a* and 125*b*. Plate support members 125A and 125B are used for the mounting of bottom plates 20 to the link members 15. This will be illustrated further in connection with FIG. 6. The mounting support members 120*a*–120*g* can be seen from the bottom of the links 15, but have been omitted in FIG. 4 to reduce clutter.

FIG. 5 illustrates the manner in which adjacent links 15 are fastened together. Depicted in this Figure are two adjacent links 15 and 15'. Each of the links is identical in manufacture. In order to fasten the two links together, the pins 140*a*'–140*d*' of link 15' are inserted into the holes 130*a*–130*d* of link 15 (as depicted in FIG. 2). The links 15 and 15' are then brought into close contact, the side wall 100 of one of link 15 being adjacent to the opposite side wall 101' of the adjacent link 15'. Once the pins 140*a*'–140*d*' have been fully inserted into the apertures 130*a*–130*d* and the links 15 and 15' have been brought together, the pins 140*a*'–140*d*' are looped around the side walls 100 and 101' and crimped to securely fasten the two links 15' and 15 together. Once crimped, the pins 140*a*'–140*d*' can be spot soldered to side wall 101' in order to provide secure fastening.

FIG. 6 is a bottom of a link 15 to which a bottom plate 20 has been attached. As previously discussed, the bottom plate 20 is secured to link 15 on plate supports 125*a* and 125*b* (see FIG. 4). Bottom plate 20 is additionally supported on each end by end supports 110 and 115. In a preferred embodiment, the plate 20 is spot soldered at side supports 110 and 115 and plate supports 125*a* and 125*b*. The apertures 170*a*–170*c* in plate 20 allow for the circulation of air in the watch band when worn.

One may note on the watch band a pattern 27 in the shape of the letter G. This denotes that several of the gem mounting locations in the links have been fitted with colored stones, for example, sapphires, and those can be strategically located to define a particular letter or a shape or a monogram. Thus, it is possible through the choice of mounting stones of various colors in the band to define a monogram thereon.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A watch assembly comprising:

a watch comprising a casing holding a watch movement, a recessed face in the casing, the recessed face comprising a first gem mounting and a first plurality of gems mounted in the gem mounting, time indicating handles mounted above the gems and moveable thereover and a watch crystal enclosing the recessed face;

a band coupled to the watch, the band including a plurality of links and the links defining a second gem mounting for a second plurality of gems; the watch and the band having their respective gem mountings so situated relative to one another such that the recessed face and the band are substantially totally covered by the gems, and the band having a width dimension which matches a corresponding width dimension of the watch so that the watch appears to be part of and a continuation of the band.

2. The watch assembly of claim 1, wherein the second gem mounting is arranged such that the second plurality of gems are arrayed in a first plurality of tightly packed circumscribing lines extending over the entirety of a length dimension of the band and the first gem mounting is formed to cause the first plurality of gems to define a second plurality of tightly packed lines extending across the watch, the first plurality of lines and the second plurality of lines being aligned with one another.

3. The watch assembly of claim 2, wherein substantially all of the first and second plurality of gems comprise invisibly set diamonds.

4. The watch assembly of claim 3, wherein a predetermined number of the gems are arranged to define a monogram.

5. The watch assembly of claim 3, wherein each of the links includes at least one pin and at least one pin of each link penetrates through at least one matching opening in an adjacent link to thereby interconnect the links to one another.

6. The watch assembly of claim 3, in which the first and second plurality of gems are also aligned linearly across a width dimension of the band and of the recessed face of the watch.

7. The watch assembly of claim 3, including bottom plates attached to a bottom side of each of the links to define a smooth and continuous surface for the band to rest on a person's wrist.

8. A watch assembly comprising:

a watch including a plurality of linearly aligned first gem mounting members; and a band coupled to the watch, the band including a plurality of links, each link including:

two end supports, a first side wall coupling the two end supports, the first side wall having a plurality of apertures formed therein, a second side wall coupling the two end supports, the second side wall having a plurality of pins extending therefrom, each of said first and second side walls having a curved upper edge, and a plurality of second gem mounting members coupling the first and second side walls, the second gem mounting members being linearly aligned with the first gem mounting members.

9. A watch assembly according to claim 8, further including gems mounted in the first and second gem mounting members.

10. A watch assembly according to claim 8, wherein each link further comprises a bottom plate coupled to the two end supports, wherein said bottom plate provides a smooth, substantially continuous surface for an inside surface of the band.

11. A watch assembly according to claim 8, wherein the band has two ends, the watch further comprising a fastening device coupling the two ends of the band, wherein when the fastening device is in a closed position, the two ends of the band are indiscernible from visual inspection.

* * * * *